US007407433B2

(12) United States Patent
Mavliev et al.

(10) Patent No.: US 7,407,433 B2
(45) Date of Patent: Aug. 5, 2008

(54) PAD CHARACTERIZATION TOOL

(75) Inventors: Rashid A. Mavliev, Campbell, CA (US); Simon Yavelberg, Cupertino, CA (US); Gerald J. Alonzo, Los Gatos, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/556,114

(22) Filed: Nov. 2, 2006

(65) Prior Publication Data

US 2007/0099545 A1 May 3, 2007

Related U.S. Application Data

(60) Provisional application No. 60/733,736, filed on Nov. 3, 2005.

(51) Int. Cl.
*B24B 49/00* (2006.01)

(52) U.S. Cl. ..... 451/6; 451/8; 451/21; 451/41; 451/285; 156/345.28; 205/645

(58) Field of Classification Search ..... 451/5, 451/6, 8, 21, 41, 54, 56, 285, 287; 156/345.28; 205/645

See application file for complete search history.

(56) References Cited

U.S. PATENT DOCUMENTS 4,793,895 A * 12/1988 Kaanta et al. ..... 438/17
5,934,974 A 8/1999 Tzeng
6,102,776 A * 8/2000 Boggs et al. ..... 451/8
6,186,864 B1 2/2001 Fisher, Jr. et al.
6,422,927 B1 7/2002 Zuniga
6,450,868 B1 9/2002 Zuniga et al.
6,517,414 B1 2/2003 Tobin et al.
6,616,513 B1 9/2003 Osterheld
6,666,754 B1 12/2003 Beckage
6,684,704 B1 2/2004 Obeng
6,811,680 B2 11/2004 Chen et al.
6,837,942 B2 1/2005 Joslyn
6,841,057 B2 1/2005 Wadensweiler et al.
6,843,706 B2 1/2005 Tsujimura et al.
6,848,977 B1 * 2/2005 Cook et al. ..... 451/41
6,857,945 B1 2/2005 Chen et al.
6,872,132 B2 3/2005 Elledge et al.
6,872,662 B1 3/2005 Hocheng et al.
6,884,153 B2 4/2005 Manens et al.
6,939,207 B2 9/2005 Jensen et al.
6,951,503 B1 * 10/2005 Gotkis et al. ..... 451/9
6,979,248 B2 * 12/2005 Hu et al. ..... 451/28
2002/0164925 A1 * 11/2002 Swedek et al. ..... 451/5
2004/0053512 A1 * 3/2004 Manens et al. ..... 438/784
2006/0009132 A1 * 1/2006 Bennett et al. ..... 451/8

* cited by examiner

*Primary Examiner*—Eileen P. Morgan
(74) *Attorney, Agent, or Firm*—Fish & Richardson

(57) ABSTRACT

Tools and methods for in-situ characterizing of a surface of a polishing pad are described. A characterization tool is integrated with polishing tool so that the polishing pad can be monitored in-situ. The characterization tool and the polishing pad can be rotated or moved so that any portion of the polishing pad can be tested.

18 Claims, 8 Drawing Sheets

PAD CHARACTERIZATION TOOL

CROSS-REFERENCE TO RELATED APPLICATIONS

This application claims the benefit of priority of U.S. Provisional Application Ser. No. 60/733,736, filed Nov. 3, 2005. The disclosure of the prior application is considered part of and is incorporated by reference in the disclosure of this application.

BACKGROUND

The present invention relates to methods and apparatus for processing integrated circuits.

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive filler layer, such as copper, can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment medium. The carrier head provides a controllable load on the substrate to push it against the polishing pad. A polishing liquid, including at least one chemically reactive agent, is supplied to the surface of the polishing pad. The polishing liquid can optionally include abrasive particles, e.g., if a standard pad is used.

A variation of CMP, which is particularly useful for copper polishing, is electrochemical mechanical processing (ECMP). The ECMP process is similar to the conventional CMP process, but has been designed for copper film polishing at very low down and shear forces, and is therefore suitable for low-k/Cu technologies. In ECMP techniques, conductive material is removed from the substrate surface by electrochemical dissolution while concurrently polishing the substrate, typically with reduced mechanical abrasion as compared to conventional CMP processes. The electrochemical dissolution is performed by applying a bias between a cathode and the substrate surface and thus removing conductive material from the substrate surface into a surrounding electrolyte.

Ideally, the CMP or ECMP process polishes the substrate layer to a desired planarity and thickness. Polishing beyond this point can lead to overpolishing (removing too much) of a conductive layer or film, which can lead to increased circuit resistance. Not polishing the substrate enough, or underpolishing (removing too little) of the conductive layer, can lead to electrical shorting. Variations in the initial thickness of the substrate layer, the polishing solution composition, the polishing pad condition, the relative speed between the polishing pad and the substrate, and the load on the substrate can cause variations in the material removal rate. These variations can occur between substrates or across the radius of a single substrate, such as when a substrate is over polished in one region and underpolished in another region. The CMP or ECMP apparatus can be selected to control the rate of polishing of a substrate.

SUMMARY

In one aspect, a polishing tool is described that is configured to characterize the surface of a polishing pad. The tool includes a carrier head support, a platen and a sensor assembly. The carrier head support supports a carrier head configured to retain a substrate during a polishing process. The platen is configured to support a conductive polishing pad, wherein the substrate contacts the conductive polishing pad during the polishing process. The sensor assembly is configured to determine one or more characteristics of the conductive polishing pad, including conductivity of the conductive polishing pad.

In another aspect, a method for determining a condition of a conductive polishing pad is described. The method includes positioning a conductive polishing pad on a polishing tool. A characterization tool is positioned over a surface of the conductive polishing pad. The characterization tool is operated to determine one or more characteristics of the conductive polishing pad.

In yet another aspect, a polishing tool is described that has a a rotatable platen for supporting a polishing pad, a rotatable carrier head support and a sensor supported by the rotatable carrier head support, wherein the sensor is positioned to scan across the polishing pad during platen rotation.

Implementations of the invention may include one or more of the following features. The sensor assembly can be supported by the carrier head support. The platen can be supported by a table and the table can support the sensor assembly. The platen can rotate. The carrier head support can be configured to rotate. The sensor assembly can be positionable over any location on the platen by rotating one or both of the platen or the carrier head support. The sensor assembly can be positionable over any location on the platen. The sensor assembly can include an optical imaging device, a laser displacement measuring device, a down force sensor or a device for determining surface contamination. The tool can include a computing device configured to receive signals from the sensor assembly and, based on the received signals, to determine whether the conductive pad requires cleaning, maintenance or replacement. The carrier head support can comprise at least two arms and the sensor assembly can be supported by the two arms. Operating the characterization tool can include contacting a conductivity sensor to a surface of the conductive polishing pad and measuring conductivity of at least a portion of the conductive polishing pad. The method can include generating a conductivity map of the conductive polishing pad. Operating the characterization tool can include operating an optical sensor to determine a surface condition of the conductive polishing pad. Operating the characterization tool can include operating a laser displacement sensor to determine a surface condition of the conductive polishing pad.

Implementations of the invention may include one or more of the following advantages. A polishing pad condition can be determined during and after pad break-in, conditioning and polishing. Monitoring the pad condition during the break-in process can optimize the amount of break-in time that is required. Maintenance or replacement of the polishing pad does not need to happen on a scheduled basis, but on an as-needed basis. This can prevent defective pads from being used in polishing, increasing substrate yield. This can also cut down on the amount of time that is spent replacing and maintaining polishing pads, because the pads are only changed or maintained when needed and not on a scheduled basis. Malfunctioning pads can be taken out of service prior to substrates being polished on the pads. Because the pad condition can be monitored over time, polishing process parameters can be altered as the pad condition changes, which may extend pad useful lifetime.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
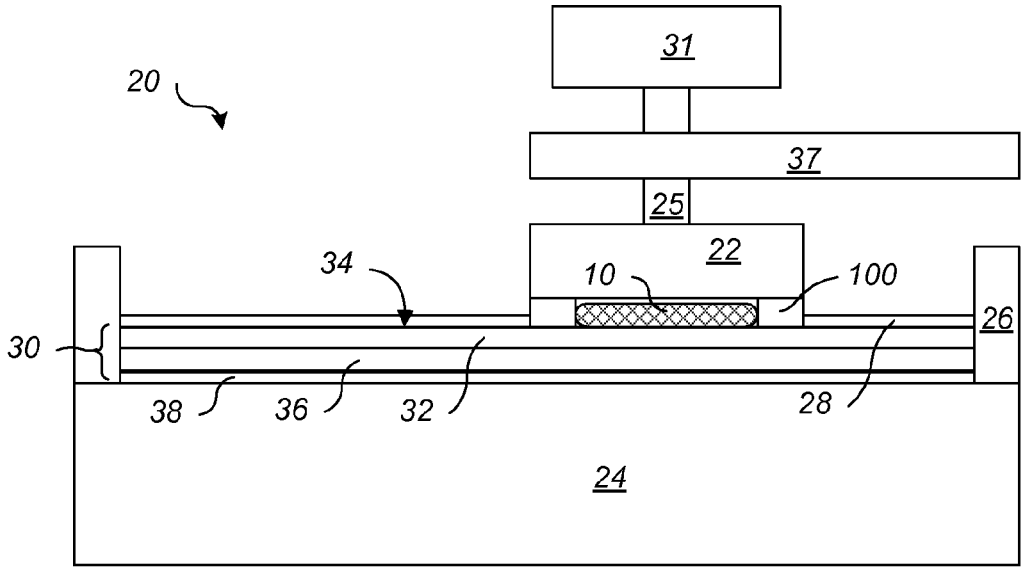
FIG. 1 is a schematic side view, partial cross-section of an ECMP polishing station.

As can be seen in FIG. 1, a substrate 10 can be polished at a polishing station 20 of an ECMP apparatus. An ECMP apparatus can have multiple polishing stations, but only one is shown for the sake of simplicity. A description of a similar conventional CMP polishing apparatus can be found in U.S. Pat. No. 5,738,574, the entire disclosure of which is incorporated herein by reference. Two fundamental differences between the ECMP apparatus and a conventional CMP polishing apparatus are, first, that in the ECMP polishing process an electrolyte is used on the platen and, second, that an electrical bias is applied to the substrate. In addition, the ECMP process may be conducted at a lower rotation speed during polishing, both to reduce stress on the substrate and to prevent splashing of the electrolyte.

The polishing station 20 includes a rotatable platen 24 on which is placed a polishing pad assembly 30. Each polishing station 20 can also include a pad conditioner apparatus (not shown) to maintain the condition of the polishing pad so that the polishing pad will effectively polish substrates. The edge of the platen 24 has a barrier wall or weir 26 so that a polishing electrolyte 28 can be contained on the polishing pad assembly 30 during polishing. An example of suitable electrolyte for ECMP polishing is described in U.S. Pat. No. 6,811,680, the entirety of which is incorporated by reference. Electrolyte solutions used for electrochemical processes such as copper plating and/or copper anodic dissolution are available from Shipley Leonel, in Philadelphia, Pa., under the tradename Ultrafill 2000, and from Praxair, in Danbury, Conn., under the tradename EP3.1. Optionally, the polishing electrolyte 28 can include abrasive particles. The polishing electrolyte can be supplied through ports in the surface of the polishing pad, or through a polishing liquid delivery arm (not shown).

The polishing pad assembly 30 can include a non-conductive polishing layer 32 with a polishing surface 34, a non-conductive backing layer 36 that can be softer than the polishing layer 32, and a counter-electrode layer 38 which abuts the surface of platen 24. The polishing layer 32 and the backing layer 36 can be a conventional two-layer polishing pad. The polishing layer 32 can be composed of foamed or cast polyurethane, possibly with fillers, e.g., hollow microspheres, and/or a grooved surface, whereas the backing layer 36 can be composed of compressed felt fibers leached with urethane. The counter-electrode layer 38, backing layer 36 and polishing layer 32 can be assembled as a single unit, e.g., the counter-electrode 38 can be adhesively attached to the backing layer 36, and the resulting polishing pad assembly 30 can then be secured to the platen.

Figure 2A:
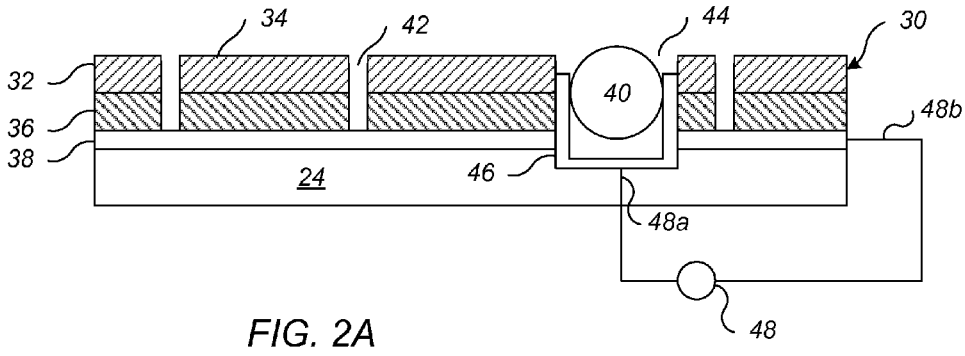
FIG. 2A shows a schematic of a cross sectional view of an ECMP polishing pad assembly having conductive rollers.

As noted above, the ECMP apparatus applies an electrical bias to the substrate 10. A variety of techniques are available to apply this electrical bias. As shown in FIG. 2A, in one implementation, the bias is applied by electrodes 40 that extend through apertures in a non-conductive dielectric polishing layer to contact the substrate 10 during polishing. The one or more apertures 44 can be formed through both the pad layers 32, 36 and the counter-electrode layer 38. The electrodes can be rotatable conductive spheres (rollers) 40 that are secured in the aperture 44 and extend slightly above the polishing surface 34. Each conductive roller 40 can be captured by a housing 46. In addition, perforations 42 can be formed through the polishing layer 32 and the backing layer 36 to expose the counter-electrode layer 38. A voltage source 48 can be connected to the conductive rollers 40 and the counter-electrode layer 38 by electrical contacts 48*a* and 48*b* (e.g., conductive electrical contacts embedded in a non-conductive platen), respectively, to apply a voltage difference between the rollers 40 and the counter-electrode layer 38. Such a system is described in U.S. Pat. No. 6,884,153 and in U.S. Pat. No. 6,841,057, the entireties of which are incorporated herein by reference.

Figure 2B:
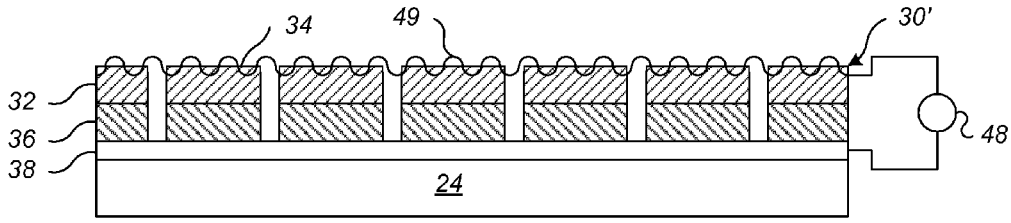
FIG. 2B shows a schematic of a cross sectional view of an ECMP polishing pad assembly having a conductive element in or on the polishing surface of a polishing pad.

As shown in FIG. 2B, in another implementation, the bias is applied by electrodes that are embedded in a non-conductive dielectric polishing layer. The polishing pad assembly 30' includes a non-conductive polishing layer 32 with a polishing surface 34, a non-conductive backing layer 36 that can be softer than the polishing layer 32, and a counter-electrode layer 38 which abuts the surface of platen 24. A conductive element 49, such as a metal wire, a conductive polymer, or a polymer composite with a conductive material, conductive metal, conductive filler or conductive doping material, is embedded in the non-conductive dielectric polishing layer 32. At least part of the conductive element 49 can project above the polishing surface 34 in order to contact the substrate during polishing. A voltage difference is applied between the conductive element 49 and the counter-electrode layer 38 by the voltage source 48. Such a polishing pad and the associated polishing system is described in the aforementioned U.S. Pat. No. 6,884,153.

Figure 2C:
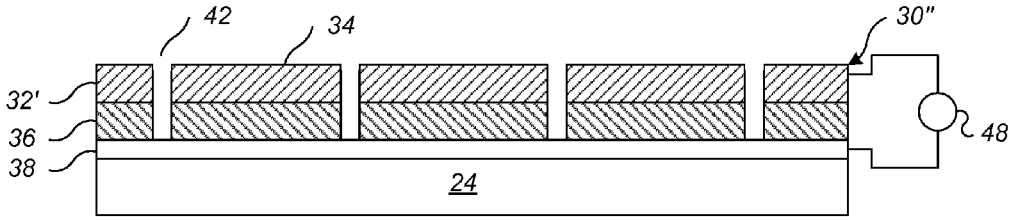
FIG. 2C shows a schematic of a cross sectional view of an ECMP polishing pad assembly having a conductive polishing surface.

As shown in FIG. 2C, in another implementation, the polishing layer itself is conductive and applies the bias. For example, referring to FIG. 2C, the polishing pad assembly 30" includes a conductive polishing layer 32' with a polishing surface 34, a non-conductive backing layer 36, and a counter-electrode layer 38 which abuts the surface of platen 24. The conductive polishing layer 32' can be formed by dispersing conductive fillers, such as fibers or particles (including conductively coated dielectric fibers and particles) through the polishing pad. The conductive fillers can be carbon-based materials, conductive polymers, or conductive metals, e.g., gold, platinum, tin, or lead. A voltage difference is applied between the conductive polishing layer 32' and the counter-electrode layer 38 by the voltage source 48. Such a polishing pad and the associated polishing system is described in the aforementioned U.S. Pat. No. 6,884,153.

Referring again to FIG. 1, a carrier head 22 of a polishing tool brings the substrate 10 to the polishing station 20. The carrier head 22 is connected by a carrier drive shaft 25 to a carrier head rotation motor 31 so that the carrier head can independently rotate about its own axis. In addition, the carrier head 22 can independently laterally oscillate in a radial slot formed in a support plate of a rotatable multi-head carousel 37. A description of a suitable carrier head 22 can be found in U.S. Pat. Nos. 6,422,927 and 6,450,868, and in 6,857,945, the entire disclosures of which are incorporated herein by reference.

In operation, the platen 24 is rotated about its central axis, and the carrier head 22 is rotated about its central axis and translated laterally across the polishing surface 34 of the polishing pad to provide relative motion between the substrate 10 and the polishing pad 30. The carrier head 22 places a controllable pressure on the substrate 10 during polishing. The carrier head 22 also retains the substrate 10 within a retaining ring 100 that is secured to the carrier head.

Figure 3:
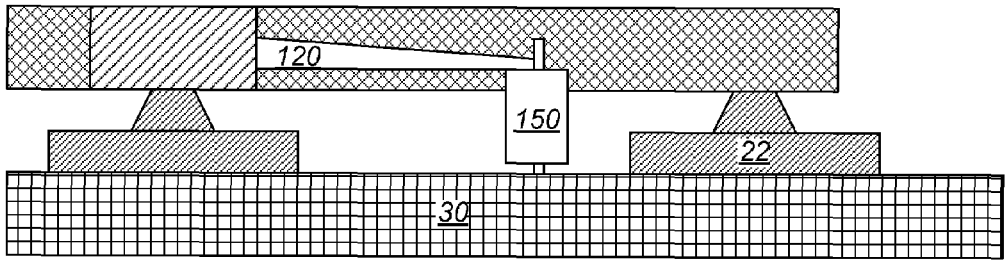
FIG. 3 is a schematic side view, partial cross-section of an ECMP polishing station with a polishing surface characterization tool mounted thereon.
Figure 4:
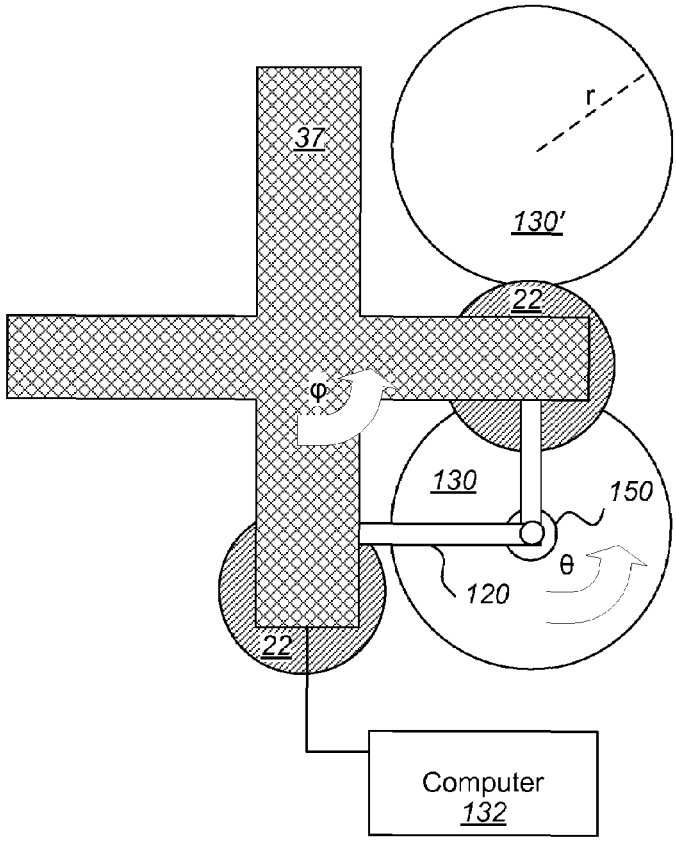
FIG. 4 is a schematic plan view of part of an ECMP polishing station with a polishing surface characterization tool mounted thereon.

Referring to FIGS. 3 and 4, a polishing pad characterization tool is mounted on the polishing tool, e.g., the ECMP apparatus. The polishing tool can include a carousel 37 described herein with one or more support arms, or a circular support platform or other suitable support for the carrier head 22. In some implementations, the carousel 37 supports the characterization tool 150. In some implementations, a support arm 120 extends from the carousel 37 and is connected to the characterization tool 150. The support arm 120 can be fixed or moveable. A moveable support arm 120 moves the characterization tool over a specified location on the platen. Even when the characterization tool 150 is statically mounted on a support arm, the characterization tool 150 can be moved over any position on the platen as described herein. In the implementation shown, the characterization tool 150 is moved over the platen before or after a polishing sequence. In some implementations, the characterization tool can be moved over the platen so that the polishing pad condition can be monitored during polishing. The characterization tool 150 can be positioned out of the way of the carrier head, such as at an edge of the platen, so as to not interfere with polishing.

The characterization tool 150 can also be moved up and away from the polishing pad or down toward the polishing pad. The tool may need to be adjacent to the polishing pad to analyze the pad. The tool may also need to be moved up and out of the way of the polishing pad so that the tool does not obstruct polishing or movement of the carrier head. Wiring that is connected to the characterization tool 150 can extend through a support arm and through the carousel 37 so that the characterization tool 150 can be controlled and can provide signals to a receiving computer.

Referring to FIG. 4, in one implementation, the carousel 37 is configured to rotate ((p rotation) so that a carrier head 22 can move a substrate from a first polishing platen 130 to a second polishing platen 130'. In some implementations, the characterization tool 150 is supported so that in at least one rotational position of the carousel, the characterization tool 150 is placed over the center of the platen. As the carousel 37 rotates in either direction over the platen, the characterization tool 150 is positioned over any desirable radius (r) of the platen between the center of the platen and the edge of the platen.

The platens 130 are also configured to rotate ($\theta$ rotation). As the characterization tool 150 is moved over the platen in any location other than the center, rotation of the platen 130 allows the tool to be placed over any rotational location of the platen 130. The $\phi$ rotation in combination with the $\theta$ rotation enable positioning the characterization tool 150 over any desired location (r, $\theta$).

As shown in FIG. 4, the characterization tool 150 is supported by two arms of a carousel 37. Attaching the characterizing tool 150 to two arms stabilizes the characterization tool 150. In some implementations, the characterization tool 150 is supported by a single arm. The characterization tool 150 can be between two arms of the carousel, or be closer to one arm than the other arm. In some implementations, the characterization tool 150 is supported by the polishing tool, but is not supported by the carousel. The platens are supported by a table. The characterization tool 150 can also be supported by the table, as described further herein. The characterization tool 150 can be moveable, for example, on a rotatable support, so that the tool can either be positioned over the platen or out of the way of the platen.

The characterization tool 150 can include one or more tools for characterizing the polishing pad:

- a pad conductivity testing device, which can test conductivity globally or locally across the polishing pad;
- a camera, such as a CCD camera, for optically inspecting the polishing pad for surface defects, pad flatness or pad surface feature quality;
- a displacement sensor, such as a laser displacement sensor for revealing wear or glazing of the pad surface;
- a shear force sensor, such as a load cell, for measuring a frictional coefficient of the pad surface to reveal wear or glazing of the pad surface or pad delamination;
- a down force sensor for indicating pad or backing layer compressibility at different down forces;
- an atomic force sensor, which can indicate the pad topology;
- a chemical analysis sensor, such as a fluorescent chemical analysis sensor, for analyzing the electrolyte or polishing slurry, which can indicate the process byproducts in-situ;
- a combined resistivity and flatness sensor, such as an inductive displacement sensor that measures local and global resistivity;
- a temperature sensor, such an infrared sensor;
- a moisture content sensor for analyzing the electrolyte or polishing slurry; or
- another suitable sensor for determining the condition of the polishing pad.

As described herein, a conductive polishing pad can include multiple layers. As noted herein, the characterization tool 150 can include a pad conductivity testing device. The pad conductivity testing device can determine the conductivity of each of the conductive layers by applying a bias across a conductive layer and the power supply. Alternatively, the global conductivity of the polishing pad assembly can be determined. The global conductivity of the polishing pad can be measured by a conductivity sensor that is in electrical communication with the power supply for the conductive polishing assembly. A local conductivity can be determined by placing sensors between two points of the polishing assembly, such as between the polishing layer and the counter electrode. This allows for mapping the conductivity of the polishing surface. In some implementations, the conductive pad is tested at different down forces to see how the conductivity changes in relationship to pressure applied by the sensor. This can indicate how applying greater pressures during polishing may affect the polishing profile. In some implementations, the characterization tool 150 includes multiple sensors.

Figure 5:
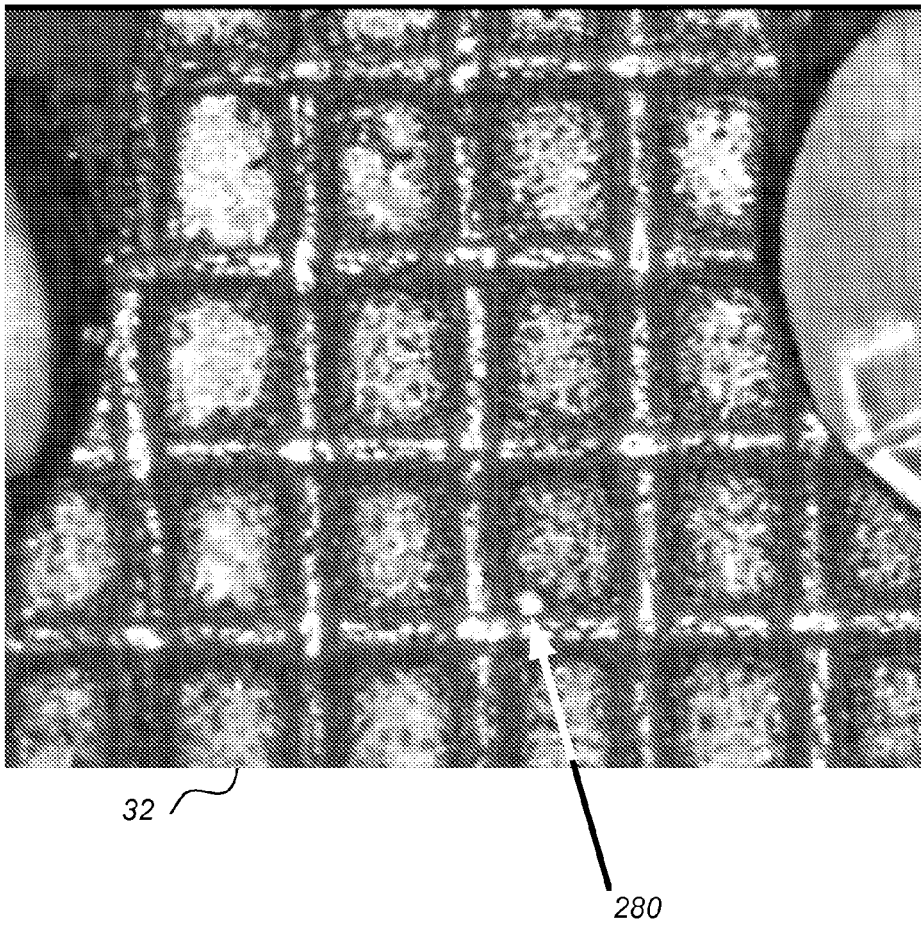
FIG. 5 shows a picture of a portion of a conductive polishing pad.

In addition to determining the conductivity of a polishing pad assembly, the characterization tool 150 can include other metrology devices, such as those described herein. In some implementations, a displacement sensor can measure the topology of the polishing pad. Referring to FIG. 5, the topology can show when there is a defect, such as a high point 280, on the polishing pad. Inconsistencies, such as high or low spots on the polishing pad, can lead to inconsistencies in polishing a substrate. Optical imaging can also be used to show any inconsistencies or damage to the surface of the polishing pad. In some implementations, a sensor mounted on the ECMP apparatus detects surface contamination, such as by chemical analysis or optically testing the pad surface.

Referring back to FIG. 4, the characterization tool 150 is in communication with a computer 132. The computer 132 is configured to receive signals from the characterization tool 150 and determine the condition of the polishing surface according to the received signals. For example, the computer 132 can determine whether the polishing surface requires modification, such as conditioning or cleaning, whether the polishing surface needs to be replaced, whether polishing conditions need to be altered or whether the polishing surface is in acceptable condition for further use. When the characterization tool 150 is positioned so that the polishing pad can be monitored during polishing or between polishing steps, the condition of the backing layer, process conditions, pad contamination and pad surface quality can all be determined before, during or after a polishing process.

The computer 132 can determine the position of the characterization tool 150 with respect to the conductive polishing pad and record the position in combination with signals received from the tool. The computer can then create a mapping of the surface conditions of the polishing pad. In some implementations, the computer is configured to record and save images from a camera that captures images during the polishing process. The computer can also be configured to process images captured by a camera and determine when irregularities on the polishing pad require pad removal or treatment. The computer can then send a warning to an operator, indicating that the polishing pad needs to be replaced. The computer can also be configured to initiate a corrective sequence, such as a cleaning or conditioning sequence, when an irregularity is discovered.

Figure 6:
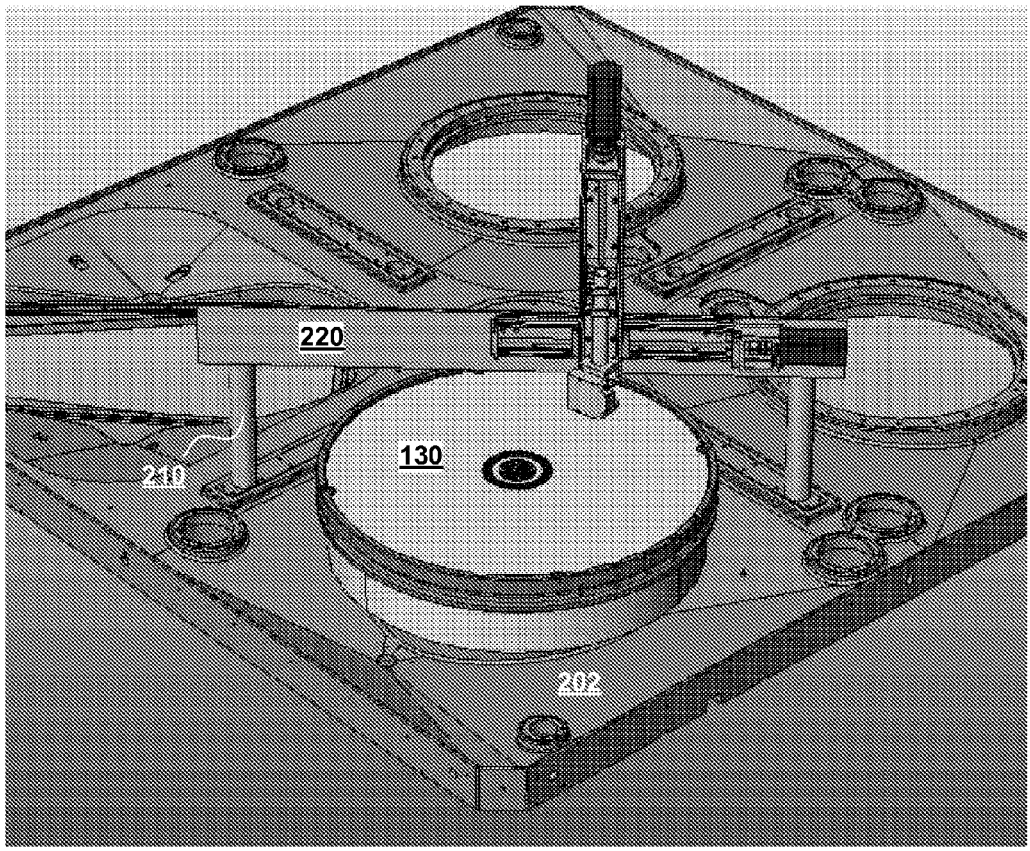
FIG. 6 shows a perspective view of a portion of a polishing tool with a polishing surface characterization tool mounted thereon.

Referring to FIG. 6, in another implementation, the characterization tool 150 is mounted on a table 202. The characterization tool 150 can be supported by one or two support legs 210. The support legs can include a support arm 220. The characterization tool 150 can be positioned so that it does not interfere with a carrier head during polishing.

Figure 7:
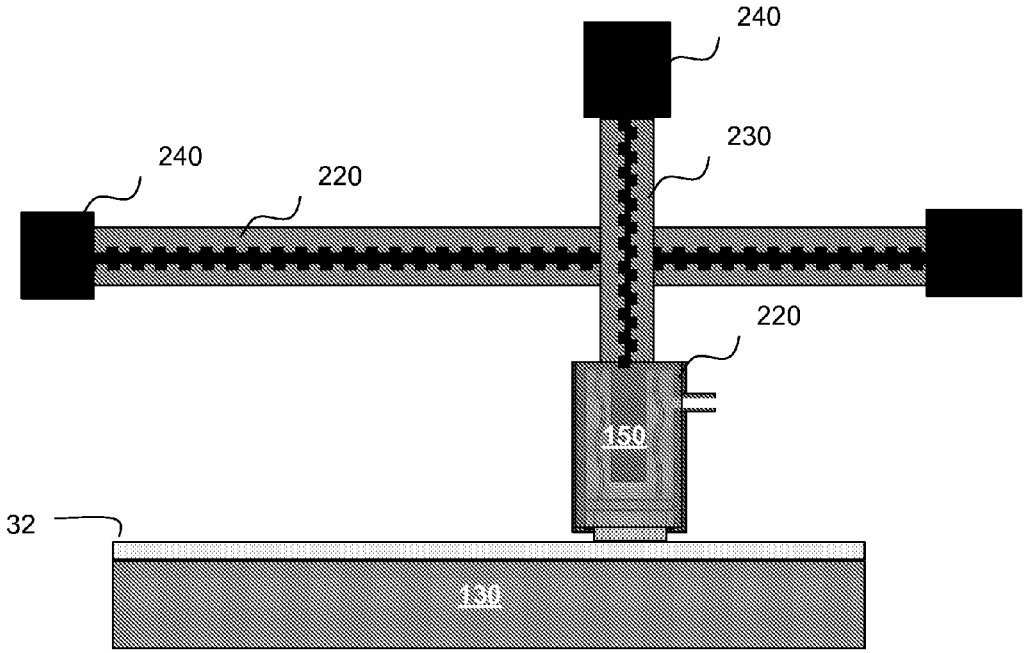
FIG. 7 shows a schematic of a side view of a mounting device for a sensor.

Referring to FIG. 7, the support arm 220 can enable displacement of the characterization tool 150. In some implementations, the support arm 220 can allow for x-displacement over the platen 130. An extension arm 230 can allow for z-displacement. The platen rotating provides the change in the θ position of the characterization tool 150 over the polishing pad. One or more electronic units 240 control the x and z positioning of the characterization tool 150. The electronic units 240 can be configured for data acquisition and processing. The electrical units 240 can also send signals to the computer 132. In some implementations, multiple sensors can be placed on the support arm 220, such as to increase measuring capacity. That is, the support arm 220 can have more than one extension arm 230 attached thereto.

Selecting one or more sensors in the characterization tool 150 can provide particular advantages. For example, a combined resistivity and flatness sensor (CRFS) can be an inductive displacement sensor and a conductivity sensor that rides freely on the top surface of the polishing pad, so that the sensor can move up and down in accordance with the changes in the topology of the polishing pad. This CRFS may work on a wet pad. The CRFS can be sufficiently wide, such as at least a half inch, at least an inch, at least 2 inches, or more in width, so that the CRFS is not sensitive to grooves or perforations in the pad. That is, if the CRFS extends over a groove or a perforation, the CRFS does not measure the groove or perforation as a defect. The CRFS can apply different contact pressures to determine the pad compressibility. A laser sensor, on the other hand, can provide higher resolution and groove and perforation measurements. Together, the laser sensor and the inductive displacement sensor can provide topology of the surface of the polishing pad at different scales.

Figure 8:
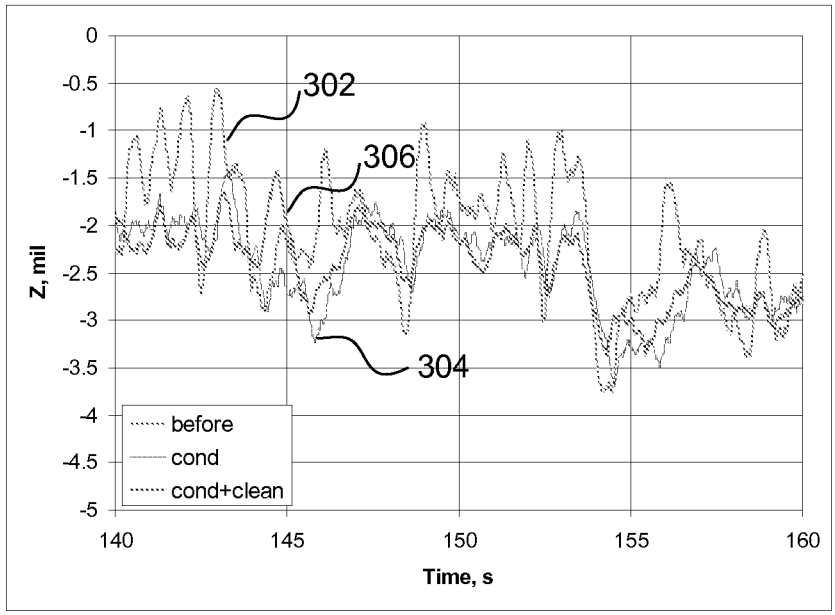
FIGS. 8 and 9 show graphs of displacement measurements before and after conditioning and cleaning a polishing pad.
Figure 9:
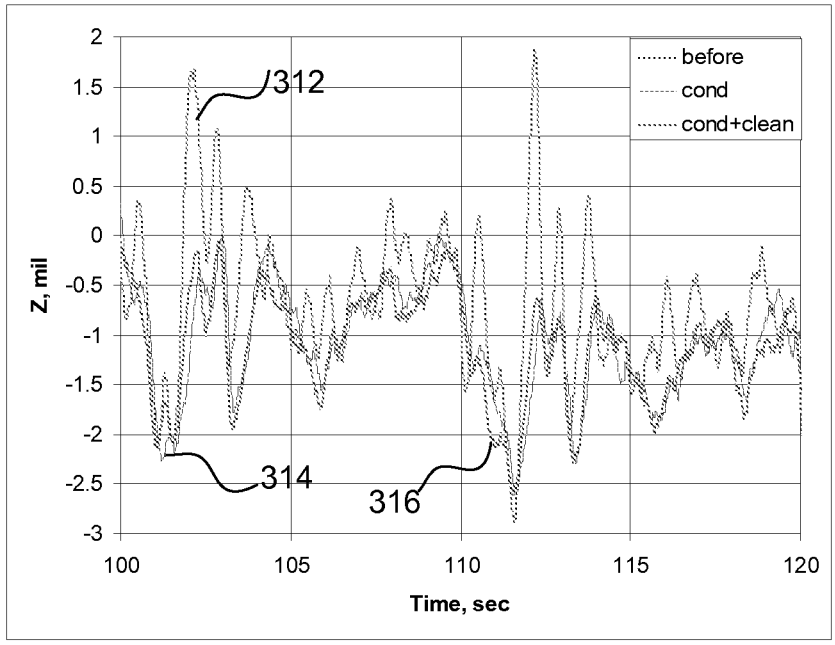

Referring to FIGS. 8 and 9, a graph of measurements before and after conditioning and cleaning shows the effects of cleaning and conditioning the pad on pad surface uniformity (two different polishing pads were measured). Lines 302, 312 show the surface measurements of the polishing pad (in mils) before cleaning the polishing pad. Lines 304, 314 shows the surface measurements of the pad after conditioning. Lines 306, 316 show the surface measurements of the pad after conditioning and cleaning the pad. At least conditioning and possibly also cleaning appear to improve the pad uniformity.

Figure 10:
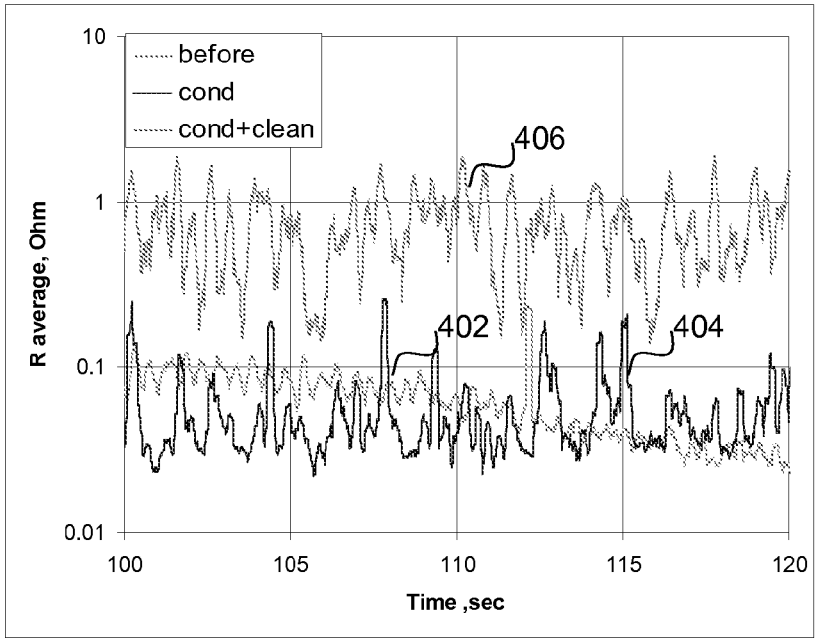
FIGS. 10 and 11 show graphs of resistivity measurements before and after conditioning and cleaning a polishing pad.
Figure 11:
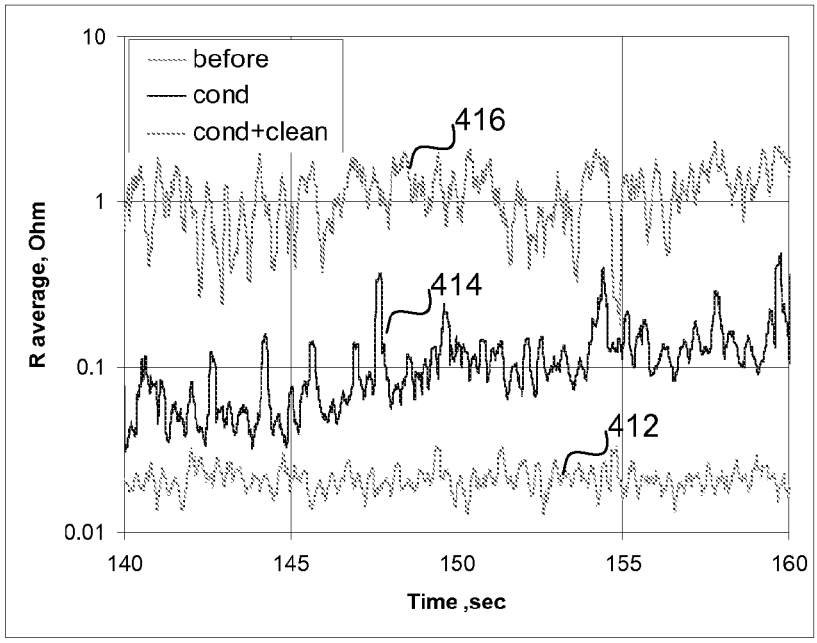

Referring to FIGS. 10 and 11, a graph shows resistivity measurements across the polishing pad before and after conditioning and cleaning. The pad prior to conditioning (lines 402, 412) has a resistivity of between about 0.05 and about 0.5 Ohm. After conditioning (lines 404, 414), the resistivity may change some. After conditioning and cleaning (lines 406, 416), the pad resistivity is around between about 0.1 Ohm and about 5 Ohms. The affects of conditioning and cleaning can be seen in the graphs. In all the graphs in FIGS. 8-11, the time correlates with an x, θ position of the polishing pad, as the characterization tool 150 moves inward from a perimeter of the polishing pad and the platen rotates the polishing pad.

As shown in the graphs, the condition of the pad can be monitored in-situ to determine if the pad condition is changing and whether the pad requires conditioning, cleaning or replacement.

A new pad may require post-manufacturing or pre-process qualification. A polishing pad can be broken in and the pad surface condition and conductivity can be monitored during break-in to optimize the process. After break-in the pad should have particular resistivity, flatness and topology. The break-in time to achieve the desired characteristics depends at least in part on the starting condition of the polishing pad and the intensity of the break-in process. The break-in time should not extend beyond achieving the desired pad characteristics, because break-in time that is too long reduces pad lifetime and wastes valuable operating time. If the pad is not sufficiently broken-in, the pad may not perform as ideally as it could. The pad condition changes during the pad's lifetime and the changes can be monitored, which can help to determine when the pad needs to be changed or serviced. The pad can become contaminated during the polishing process, such as by material removed from the substrate or the polishing solution, e.g., electrolyte solution. Further, the operator can determine when a pad need not be changed. This can save the time and materials that are expended when a pad is changed prophylacticly, that is, the pads can be cleaned, conditioned or changed when needed, rather than on a scheduled preventative basis. Scheduled preventative changing of the polishing pad can cause a pad to be removed more often that is actually required. The polishing pad condition can be monitored over time, even between polishing wafers. Monitoring the polishing pad condition can indicate how polishing process parameters ought to be altered to account for changes in the pad characteristics.

A number of embodiments of the invention have been described. Nevertheless, it will be understood that various modifications may be made without departing from the spirit and scope of the invention. For example, although an ECMP apparatus is described herein, the characterization tool can be used with a polishing surface that is either conductive or non-conductive. Accordingly, other embodiments are within the scope of the following claims.

What is claimed is:

1. A polishing tool configured to characterize the surface of a polishing pad, comprising:

a carrier head support supporting a carrier head configured to retain a substrate during a polishing process;

a platen configured to support a conductive polishing pad, wherein the substrate contacts the conductive polishing pad during the polishing process; and a sensor assembly, wherein the sensor assembly is configured to contact a conductive portion of the conductive polishing pad and apply a bias to the conductive portion to determine conductivity of the conductive polishing pad.

2. The polishing tool of claim 1, wherein the sensor assembly is supported by the carrier head support.

3. The polishing tool of claim 1, wherein the platen is supported by a table and the table supports the sensor assembly.

4. The polishing tool of claim 1, wherein the platen is configured to rotate.

5. The polishing tool of claim 4, wherein the carrier head support is configured to rotate.

6. The polishing tool of claim 5, wherein the sensor assembly is positionable over any location on the platen by rotating one or both of the platen or the carrier head support.

7. The polishing tool of claim 1, wherein the sensor assembly is positionable over any location on the platen.

8. The polishing tool of claim 1, wherein the sensor assembly includes an optical imaging device.

9. The polishing tool of claim 1, wherein the sensor assembly includes a laser displacement measuring device.

10. The polishing tool of claim 1, wherein the sensor assembly includes a down force sensor.

11. The polishing tool of claim 1, wherein the sensor assembly includes a device for determining surface contamination.

12. The polishing tool of claim 1, further comprising a computing device configured to receive signals from the sensor assembly and based on the received signals to determine whether the conductive pad requires cleaning, maintenance or replacement.

13. The polishing tool of claim 1, wherein:

the carrier head support further comprises at least two arms; and the sensor assembly is supported by the at least two arms of the carrier head support.

14. A method of determining a condition of a conductive polishing pad, comprising:

positioning a conductive polishing pad on a polishing tool;

positioning a characterization tool over a surface of the conductive polishing pad; and operating the characterization tool while the tool is in contact with a conductive portion of the conductive polishing pad to determine conductivity of the conductive polishing pad, wherein operating the characterization tool includes applying a bias to the conductive portion.

15. The method of claim 14, further comprising:

sending signals from the characterization tool to a computer; and based on the signals, determining whether the conductive polishing pad requires maintenance, cleaning or replacement.

16. The method of claim 14, further comprising generating a conductivity map of the conductive polishing pad.

17. The method of claim 14, wherein operating the characterization tool includes operating an optical sensor to determine a surface condition of the conductive polishing pad.

18. The method of claim 14, wherein operating the characterization tool includes operating a laser displacement sensor to determine a surface condition of the conductive polishing pad.

* * * * *